US005172541A

United States Patent [19]

Schmalz

[11] Patent Number: 5,172,541

[45] Date of Patent: Dec. 22, 1992

[54] LOADING AND UNLOADING OF ROVING SPOOLS IN A RING-SPINNING MACHINE

[75] Inventor: Erich Schmalz, Reichenbach/Fils, Fed. Rep. of Germany

[73] Assignee: Zinser Textilmaschinen GmbH, Ebersbach/Fils, Fed. Rep. of Germany

[21] Appl. No.: 683,979

[22] Filed: Apr. 10, 1991

[30] Foreign Application Priority Data

Apr. 10, 1990 [DE] Fed. Rep. of Germany ..... 4011619

[51] Int. Cl.[5] ..... D01H 9/00; D02H 1/00

[52] U.S. Cl. ..... 57/281; 57/90; 242/35.5 A; 242/131

[58] Field of Search ..... 57/90, 281; 242/35.5 A, 242/131

[56] References Cited

U.S. PATENT DOCUMENTS

| | | | |
|---|---|---|---|
| 1,987,777 | 1/1935 | Jewett | 57/90 |
| 2,969,635 | 1/1961 | Keyser | 57/1 R |
| 4,473,997 | 10/1984 | Kawasaki et al. | 57/281 X |
| 4,753,065 | 6/1988 | Mack et al. | 57/266 |
| 4,799,353 | 1/1989 | Kawasaki et al. | 57/90 |

FOREIGN PATENT DOCUMENTS

| | | | |
|---|---|---|---|
| 0329965 | 2/1988 | European Pat. Off. . | |
| 0310871 | 4/1989 | European Pat. Off. | 57/281 |
| 3606612 | 9/1987 | Fed. Rep. of Germany . | |
| 3718745 | 12/1988 | Fed. Rep. of Germany . | |
| 3723142 | 1/1989 | Fed. Rep. of Germany . | |
| 0017852 | 5/1985 | Japan | 57/281 |
| 0001533 | 1/1986 | Japan | 57/281 |
| 1192837 | 8/1989 | Japan | 57/281 |

*Primary Examiner*—Daniel P. Stodola
*Assistant Examiner*—William Stryjewski
*Attorney, Agent, or Firm*—Herbert Dubno; Andrew Wilford

[57] ABSTRACT

Full roving spools are charged into and empty spools are unloaded from a spinning machine having at least one pair of parallel spaced-apart rows of roving spools by first moving spools as they become empty to a position between the two rows of active roving spools and thereby leaving the respective positions empty and then transporting them off in a predetermined direction along a path extending parallel to and between the rows. Then full spools are transported along the path in the direction to positions adjacent positions from which empty spools have been taken and are then moved laterally into the empty positions to fill same.

6 Claims, 2 Drawing Sheets

LOADING AND UNLOADING OF ROVING SPOOLS IN A RING-SPINNING MACHINE

FIELD OF THE INVENTION

The present invention relates to the operation of a ring-spinning machine with at least two rows of active roving spools. More particularly this invention concerns loading roving bobbins into such a machine and unloading empty cores therefrom.

BACKGROUND OF THE INVENTION

A standard spinning machine normally has four banks or rows of stations two at either side of the machine at each of which a multiplicity of roving spools or package are held. A respective roving is pulled off each package and spun into yarn and, once the package is substantially depleted, the empty core is exchanged for a full one and the leading end of the new roving is attached to the trailing end of the roving of the depleted core or is threaded through the spinner.

In European patent application 329,965 filed by I. Fritschi et al based on a Swiss priority of 09 Feb. 1988 and citing U.S. Pat. Nos. 1,987,777 and 2,969,635 a circular or disk-shaped transfer device is used. This is fitted with one spool and can be transported along a transfer path transverse to the rows of a spinning station of the machine. These transfer paths extend perpendicular to the spinning-station rows so that it is necessary to provide one entire system for bringing in full packages and another for carrying off empty ones for each row of roving spools. As a result the spinning machine must be fairly wide.

To service the inner row of roving spools the large-diameter full packages must be lifted over the outer row as described in German patent document 3,723,142 filed 13 Jul. 1987 by K. Lauk et al and in U.S. Pat. No. 4,753,065 of K. Mack et al. These systems are not usable when there is insufficient overhead space at the spinning machine.

It has also been suggested in U.S. Pat. 4,799,353 of Y. Kawasaki et al to switch the packages in the inner row with the respective packages in the outer row so only the outer row needs to be serviced. Such an arrangement is fairly complex. Similarly German patent document 3,718,745 filed 04 Jun. 1987 by M. Zeiser proposes making the packages in the Working row slidable so they can be moved off to a transport row. The frame in such a system is fairly bulky so that it cannot be used in all situations.

OBJECTS OF THE INVENTION

It is therefore an object of the present invention to provide an improved method of and apparatus for servicing a spinning machine with at least two rows of roving spools.

Another object is the provision of such an improved method of and apparatus for servicing a two-row spinning machine which overcomes the above-given disadvantages, that is which is relatively simple and that can be adapted to most working environments.

SUMMARY OF THE INVENTION

According to this invention full roving spools are charged into and empty spools are unloaded from the reel of a spinning machine having a pair of parallel spaced-apart rows of roving spools by first moving spools as they become empty to a changing position between the two rows of spools and thereby leaving the respective working positions empty and then transporting them off in a predetermined direction along a path extending parallel to and between the rows. Then full spools are transported along the path in the direction changing positions adjacent working positions from which empty spools have been taken and ar then moved laterally into the empty working positions to fill same.

With this system, therefore, both rows of the spinning machine can be serviced with equal ease, without disturbing what is going on in the other row or having to move over or between the spools in the other row.

According to further features of this invention the path is annular and endless. Full spools are supplied to the path upstream in the direction from the changing positions and empty spools are removed from the path downstream in the direction from the changing positions and upstream from the supply location. It is also possible to do this loading and unloading of the track at generally the same location.

The apparatus according to this invention therefore comprises a track extending longitudinally between the rows of roving spools and a device for supplying full roving spools to one end of the track and for removing empty spools from the other end thereof. In addition a device is provided that is movable along the track for transporting spools as they become empty from the working positions to create empty working positions and for moving full spools from the track into the empty working positions.

The transfer device includes a grab transversely displaceable between a position in at least one of the rows of roving spools and a position underneath the track. A carriage carries the grab and can also carry the track. Alternately the track can be supported on the spinning machine.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
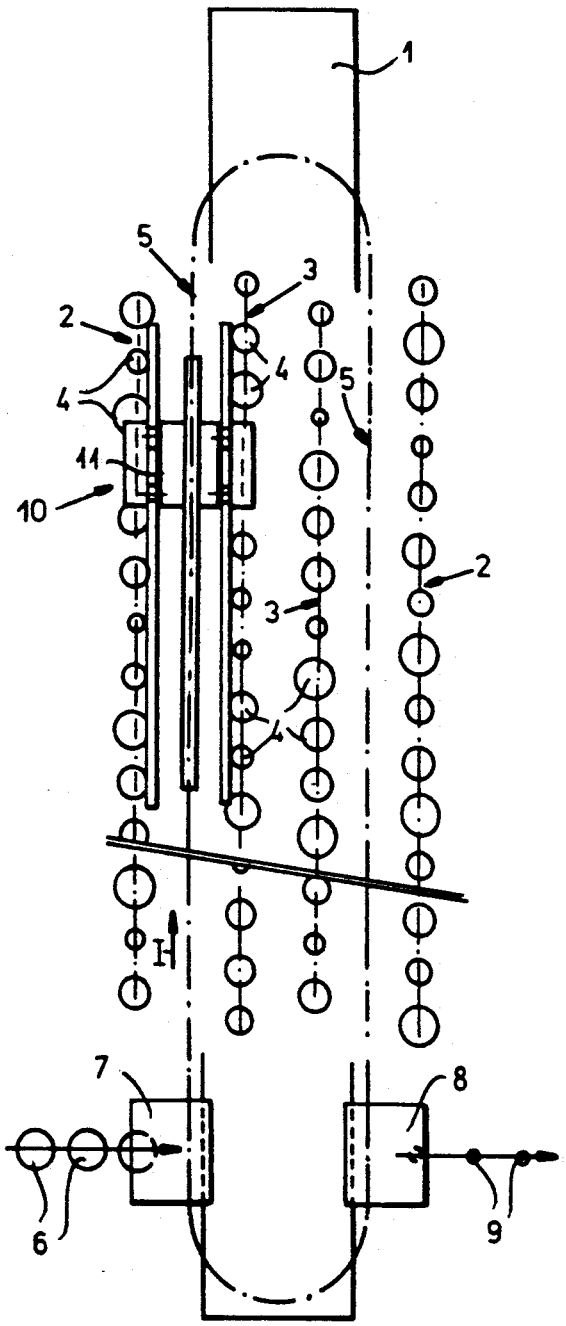
FIG. 1 is a schematic top view of the system of this invention.
Figure 3:
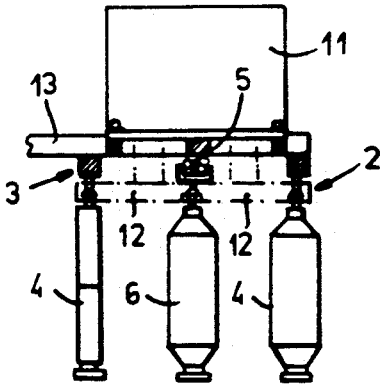
FIG. 3 is a vertical section through the transfer device according to the present invention.

As seen in FIGS. 1 and 3 a conventional ring-spinning machine 1 has outer and inner rows 2 and 3 at which are held active roving spools or packages 4 from which respective rovings are being pulled and spun. The rows 2 and 3 are parallel to each other and flank a service path or track 5 along which full packages 6 and empty spools 9 move in a direction I. The full packages 6 are loaded onto the track 5 upstream of the two rows 2 and 3 at a loading station 7 and the empty spools 9 are removed from it at a downstream unloading station 8.

Figure 2A:
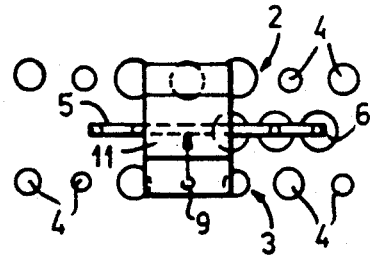
FIGS. 2*a* through 2*d* are detail top views illustrating successive steps according to the invention.
Figure 2B:
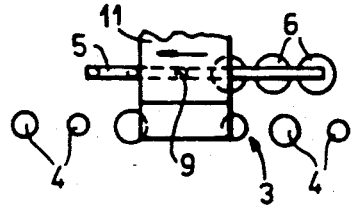
Figure 2C:
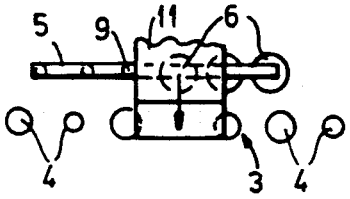
Figure 2D:
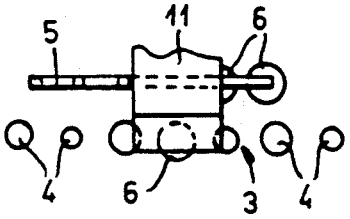

A transfer device 10 has a carriage 11 that can ride via rollers on the frame 13 of the machine 1 above the track 5 between the two rows 2 and 3 and has a transfer grab shown schematically at 12 in FIG. 3. As seen in FIG. 2*a* when a spool runs out the carriage 11 is moved next to it and then as seen in FIG. 2*b* the empty spool 9 is pulled from, for instance, the row 3 into the center track 9 by grab 12 (shown in FIG. 3) where it is hung on a holder on the stepwise-moving track 5. Then as seen in FIG. 2*c* the row of spools on the track 5 is stepped downstream sufficiently to align a full package 6 with the now-empty station in row 3. Then as shown in FIG. 2*d* the grab 12 moves this full spool 6 is moved across into place by grab 12 (shown in FIG. 3).

The transfers can be triggered by sensors which detect package diameter and/or weight and swap out an empty spool 9 when one is detected, or they can work by detecting length of filament pulled off. Alternately the transfers can simply be done periodically, even in batches if desired, to ensure that no supplies actually run out.

In this arrangement the apparatus 10 services both rows 2 and 3. The track 5 is supported on struts on the structure that carries the rows 2 and 3 of active spools 4. The transfer device can be a simple grab which manipulates the spools or bobbins. It can also be a pivotal or carousel-type system which moves the holders of the spools along corresponding guide rails between the working rows 2 and 3 and the transport row 5. In any case the grab 12 must be able to move inward out of the way to permit the carriage 11 to move along the rows 2 and 3 without interfering with the work going on in them.

Figure 4:
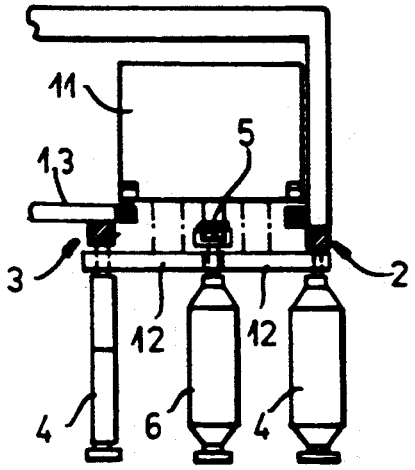
FIG. 4 is a view like FIG. 3 of an alternative arrangement according to the invention.

In FIG. 4 the carriage 11 itself carries the track 5 which is between the two stationary tracks 2 and 3. This carriage 11 carries the transfer device or grab 12.

Figure 5:
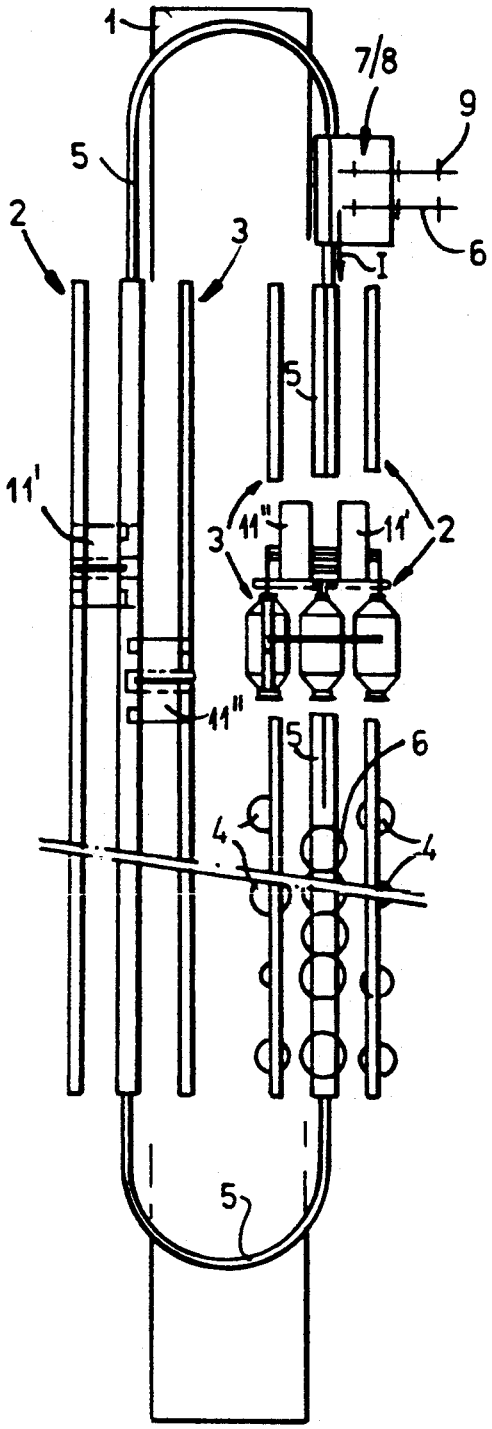
FIG. 5 is a view like FIG. 1, partly in top view and partly in end view of another system according to the invention.
Figure 6:
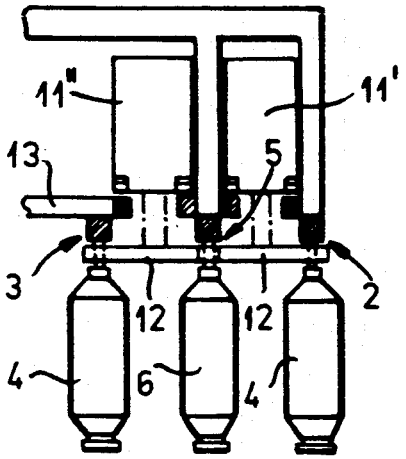
FIG. 6 is a larger-scale end view of the system of FIG. 5.

FIGS. 5 and 6 show a system wherein each of the two rows 2 and 3 has its own carriage 11' and 11''. Each such carriage 11' and 11'' has its own transfer device 12 for swapping out empty spools 9 and loading in full spools 6. In this arrangement a common loading/unloading device 7/8 is provided that, at a single location, takes off the empty spools 9 and loads on full spools 6.

I claim:

1. A method for changing full roving spools into and unloading empty spools from a spinning machine having a pair of parallel, spaced-apart, and horizontally extending rows of working positions each holding a respective plurality of active roving spools, the method comprising the steps of:

moving a spool as it becomes empty substantially only horizontally and transversely to the respective row from a working position in the respective row to a respective changing position between the two rows of active spools without displacing it through either of the rows of working positions and thereby leaving the respective working position empty;

transporting the empty spool off substantially only horizontally in a predetermined horizontal direction along a horizontal path extending parallel to and between the rows;

transporting a full spool substantially only horizontally along the path in the direction to the changing position adjacent the working position from which the empty spool has been taken; and moving the full spool substantially only horizontally and transversely of the rows from the path laterally into the empty working position to fill same without displacing the full spool through either of the rows of working positions.

2. The method defined in claim 1 wherein the path is annular and endless, the method further comprising the steps of:

supplying full spools at a supply location to the path upstream in the direction from the changing positions; and removing empty spools from the path downstream in the direction from the changing positions and upstream from the supply location.

3. In combination with a spinning machine having at least one pair of horizontal, parallel, and spaced-apart longitudinal rows of working positions holding respective roving spools, a roving-spool-changing apparatus comprising:

a track extending longitudinally and horizontally between the rows of roving spools;

means for supplying full spools to one end of the track and for removing empty spools from the other end thereof; and transfer means movable along the track for moving spools substantially only horizontally a they become empty in the rows from the rows to the track to create empty positions and for moving full spools substantially only horizontally form the track into the empty positions without displacing empty or full spools through either of the rows of working positions.

4. The spool-changing apparatus defined in claim 3 wherein the transfer means includes a grab transversely displaceable between a working position in at least one of the rows and a changing position underneath the track.

5. The spool-changing apparatus defined in claim 4 wherein the transfer means includes a carriage displaceable along the track and carrying the grab.

6. The spool-changing apparatus defined in claim 4 wherein the track is supported on the spinning machine.

* * * * *